US011623443B2

(12) United States Patent
Nakata et al.

(10) Patent No.: US 11,623,443 B2
(45) Date of Patent: Apr. 11, 2023

(54) LIQUID EJECTING APPARATUS, METHOD FOR CONTROLLING LIQUID EJECTING APPARATUS

(71) Applicant: SEIKO EPSON CORPORATION, Tokyo (JP)

(72) Inventors: Toshio Nakata, Matsumoto (JP); Yuichi Urabe, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 17/341,603

(22) Filed: Jun. 8, 2021

(65) Prior Publication Data

US 2021/0379892 A1 Dec. 9, 2021

(30) Foreign Application Priority Data

Jun. 9, 2020 (JP) ..... JP2020-099896

(51) Int. Cl.
*B41J 2/165* (2006.01)
*B41J 2/17* (2006.01)

(52) U.S. Cl.
CPC ..... *B41J 2/16505* (2013.01); *B41J 2/16511* (2013.01); *B41J 2/16517* (2013.01); *B41J 2/1721* (2013.01)

(58) Field of Classification Search
CPC ..... B41J 2/16505; B41J 2/16511; B41J 2/16517; B41J 2/1721; B41J 2002/1742; B41J 2/16508; B41J 2/16526; B41J 2/185
See application file for complete search history.

(56) References Cited

U.S. PATENT DOCUMENTS 7,905,571 B2 * 3/2011 Byun ..... B41J 2/1721 347/29
2007/0171252 A1 7/2007 Yamamoto

FOREIGN PATENT DOCUMENTS

| | | | |
|---|---|---|---|
| JP | 2000185414 | A | 7/2000 |
| JP | 2002086759 | A | 3/2002 |
| JP | 2002361906 | A | 12/2002 |
| JP | 2007190855 | A | 8/2007 |
| JP | 2010036459 | A | 2/2010 |
| JP | 2014094450 | A | 5/2014 |

* cited by examiner

*Primary Examiner* — Geoffrey S Mruk
(74) *Attorney, Agent, or Firm* — Chip Law Group

(57) ABSTRACT

A liquid ejecting apparatus includes a liquid ejecting head configured to eject liquid from a nozzle onto a medium to perform printing, a liquid accommodating unit configured to receive, via an opening, the liquid ejected by empty discharging that ejects the liquid from the liquid ejecting head separately from the printing, a cover movable to a closed position where the opening of the liquid accommodating unit is covered and an open position where the opening is opened, and a detection unit configured to detect the cover positioned at the closed position or the open position.

11 Claims, 3 Drawing Sheets

LIQUID EJECTING APPARATUS, METHOD FOR CONTROLLING LIQUID EJECTING APPARATUS

The present application is based on, and claims priority from JP Application Serial Number 2020-099896, filed Jun. 9, 2020, the disclosure of which is hereby incorporated by reference herein in its entirety.

BACKGROUND

1. Technical Field

The present disclosure relates to a liquid ejecting apparatus such as a printer, and a method for controlling a liquid ejecting apparatus.

2. Related Art

For example, as in JP 2014-94450 A, there is a printer that is an example of a liquid ejecting apparatus that jets liquid from a liquid jet head, which is an example of a liquid ejecting head to perform printing. The printer performs flushing, which is an example of empty discharging that forcibly jets liquid from the liquid jet head to discharge thickened liquid, and restores jet characteristics.

The printer includes a liquid accommodating unit configured to accommodate liquid discharged by the empty discharging, a lid member, which is an example of a cover configured to cover an opening of the liquid accommodating unit, and a movement mechanism configured to move the lid member. The lid member is arranged at an open lid position where the opening is opened when the empty discharging is performed, and the lid member is arranged at a close lid position where the opening is covered when the empty discharging is not performed.

For example, when the cover adheres to the liquid accommodating unit, there is a possibility that the cover cannot be moved correctly. When liquid is discharged from the liquid ejecting head with the cover covering the liquid accommodating unit, the cover will be contaminated.

SUMMARY

A liquid ejecting apparatus for solving the above problem includes a liquid ejecting head configured to eject liquid from a nozzle onto a medium to perform printing, a liquid accommodating unit configured to receive, via an opening, the liquid ejected by empty discharging that ejects the liquid from the liquid ejecting head separately from the printing, a cover movable to a closed position where the opening of the liquid accommodating unit is covered and an open position where the opening is opened, and a detection unit configured to detect the cover positioned at the closed position or the open position.

A method for controlling a liquid ejecting apparatus for solving the above problem is a control method for a liquid ejecting apparatus that includes a liquid ejecting head configured to discharge liquid from a nozzle onto a medium to perform printing, a liquid accommodating unit configured to receive, via an opening, the liquid ejected by empty discharging that ejects the liquid from the liquid ejecting head separately from the printing, a cover movable to a closed position where the opening of the liquid accommodating unit is covered and an open position where the opening is opened, and a detection unit configured to detect the cover positioned at the closed position or the open position, wherein after movement of the cover to the open position is instructed, the detection unit detects that the cover moves to the open position.

DESCRIPTION OF EXEMPLARY EMBODIMENTS

Figure 1:
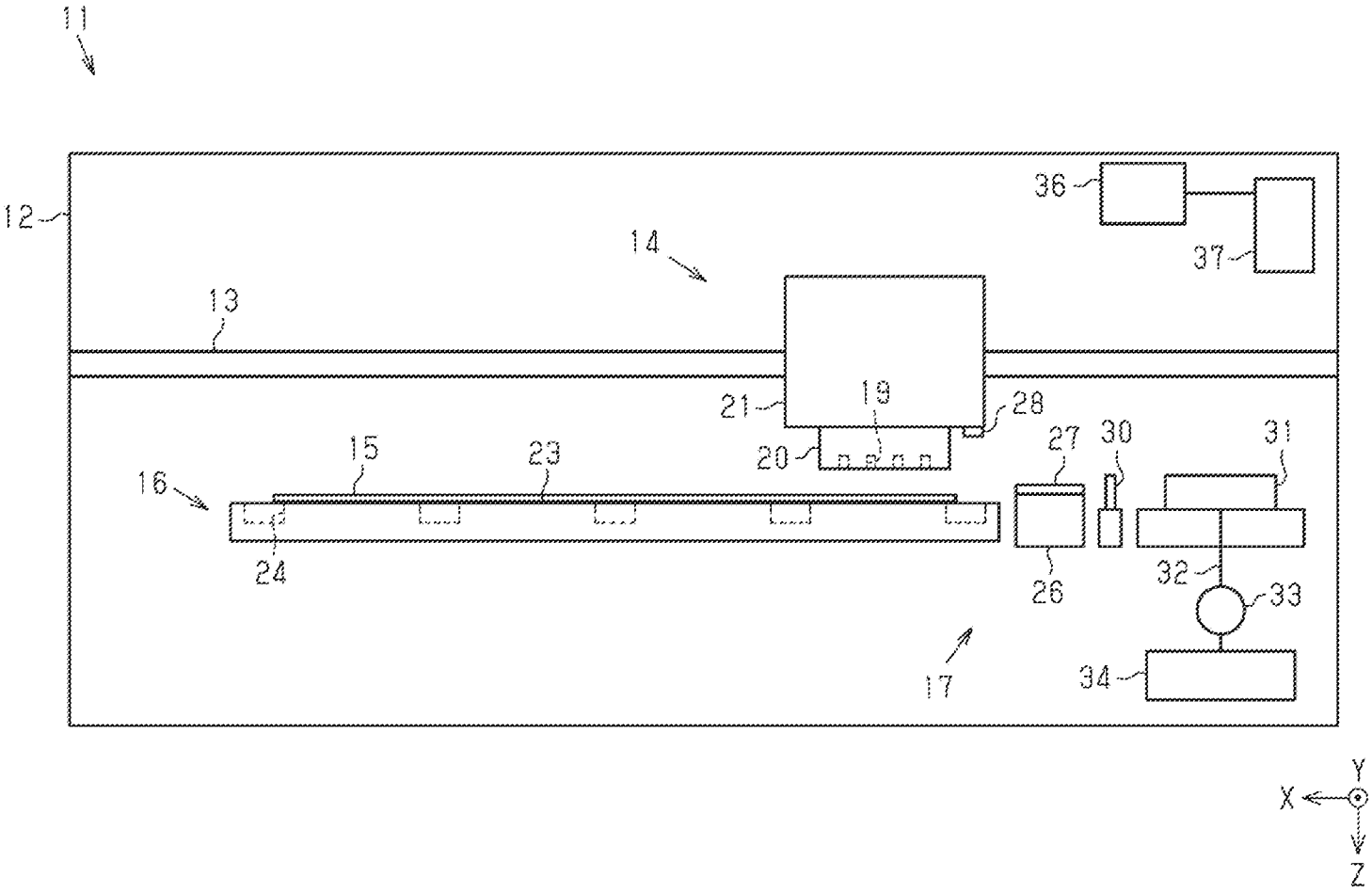
FIG. 1 is a schematic view of an exemplary embodiment of a liquid ejecting apparatus.

An exemplary embodiment of a liquid ejecting apparatus, and a method for controlling a liquid ejecting apparatus will be described below with reference to the drawings. The liquid ejecting apparatus is, for example, an ink-jet type printer configured to discharge ink, which is an example of liquid, onto a medium such as a sheet, to perform printing.

In the drawings, a direction of gravity is indicated by a Z-axis while assuming that a liquid ejecting apparatus 11 is placed on a horizontal surface, and directions along the horizontal surface are indicated by an X-axis and a Y-axis. The X-axis, Y-axis, and Z-axis are orthogonal to each other.

As illustrated in FIG. 1, the liquid ejecting apparatus 11 may include a housing 12, a guide shaft 13 supported by the housing 12, and a printing portion 14 provided so as to be movable along the guide shaft 13. The liquid ejecting apparatus 11 may include a medium support portion 16 that supports a medium 15, and a maintenance portion 17 that maintains the printing portion 14. The housing 12 accommodates the guide shaft 13, the printing portion 14, the medium support portion 16, and the maintenance portion 17.

The printing portion 14 includes a liquid ejecting head 20 that performs printing by discharging liquid from a nozzle 19 onto the medium 15, and a carriage 21 movable in a state in which the liquid ejecting head 20 is mounted thereon. The carriage 21 moves the liquid ejecting head 20 along the guide shaft 13. The liquid ejecting head 20 discharges liquid from the nozzle 19 while moving, and performs printing on the medium 15.

The medium support portion 16 supports a portion of the medium 15 on which printing is performed by the printing portion 14. The medium support portion 16 includes a support face 23 that supports the medium 15, and a recessed portion 24 that is recessed with respect to the support face 23. The recessed portion 24 may accommodate an absorbent body (not illustrated) that absorbs liquid. The recessed portion 24 accommodates liquid discharged outside the medium 15, for example, when the printing portion 14 performs borderless printing. The medium support portion 16 may include the plurality of recessed portions 24. The medium support portion 16 may include the two recessed portions 24, and the recessed portion 24 may accommodate liquid discharged outside both ends of the medium 15 respectively. The medium support portion 16 may include the three or more recessed portions 24 in accordance with a size of the medium 15 on which printing can be performed by the liquid ejecting apparatus 11.

The maintenance portion 17 includes a liquid accommodating unit 26 that receives liquid discharged by empty discharging from the liquid ejecting head 20, a cover 27 provided above the liquid accommodating unit 26, and a detection unit 28 that detects the cover 27. The detection unit 28 of the present exemplary embodiment is provided at the carriage 21, and detects the cover 27 in accordance with movement of the carriage 21. The empty discharging is maintenance that suppresses thickening of liquid in the liquid ejecting head 20, by, separately from printing, discharging liquid from the liquid ejecting head 20. The liquid accommodating unit 26 may accommodate an absorbent body that absorbs liquid, or may accommodate a moisturizer that moisturize an inside of the liquid accommodating unit 26.

The maintenance portion 17 may include a wiping unit 30 for wiping the liquid ejecting head 20, and a cap 31 that covers the nozzle 19. The maintenance portion 17 may include a discharge passage 32 whose upstream end is coupled to the cap 31, and a discharge pump 33 provided in the middle of the discharge passage 32.

The wiping unit 30 is provided so as to be movable between a wiping position where the liquid ejecting head 20 can be wiped, and a non-wiping position where the liquid ejecting head 20 is not in contact therewith. The wiping unit 30 positioned at the wiping position contacts the moving liquid ejecting head 20 to wipe the liquid ejecting head 20. The maintenance that the wiping unit 30 wipes the liquid ejecting head 20 is also referred to as wiping.

The cap 31 is provided so as to be movable between a capping position where the cap 31 contacts the liquid ejecting head 20, and a spaced position where the cap 31 is away from the liquid discharge head 20. The cap 31 positioned at the capping position contacts the liquid ejecting head 20, and thus forms a closed space in which the nozzle 19 opens between the cap 31 and the liquid ejecting head 20. The cap 31 moves from the capping position to the spaced position to open the closed space.

The discharge passage 32 may be configured by a tube that deforms as the cap 31 moves. The downstream end of the discharge passage 32 is coupled to a waste liquid accommodation unit 34 that accommodates liquid discharged from the liquid ejecting head 20 as waste liquid. The discharge pump 33 depressurizes an inside of the closed space formed by the cap 31 via the discharge passage 32, and forcibly causes liquid to be discharged from the nozzle 19. The discharged liquid is accommodated in the waste liquid accommodation unit 34 as waste liquid. The maintenance for depressurizing the inside of the closed space and discharging liquid is also referred to as suction cleaning.

The liquid ejecting apparatus 11 may include a notification unit 36 that can notify of information related to the liquid ejecting apparatus 11. The notification unit 36 may be a monitor that performs notification by displaying images, characters, and the like, or may be a touch panel that enables display and operation. The notification unit 36 may be a speaker that performs notification by emitting voice, sound, or the like, or may be a bell. The notification unit 36 may be a light that performs notification by light emission, flashing, or the like.

The liquid ejecting apparatus 11 includes a control unit 37 that controls operation of the liquid ejecting head 20 and the maintenance portion 17. The control unit 37 is, for example, constituted by a processing circuit including a computer and a memory, and controls various operations performed by the liquid ejecting apparatus 11 in accordance with a program stored in the memory.

Figure 2:
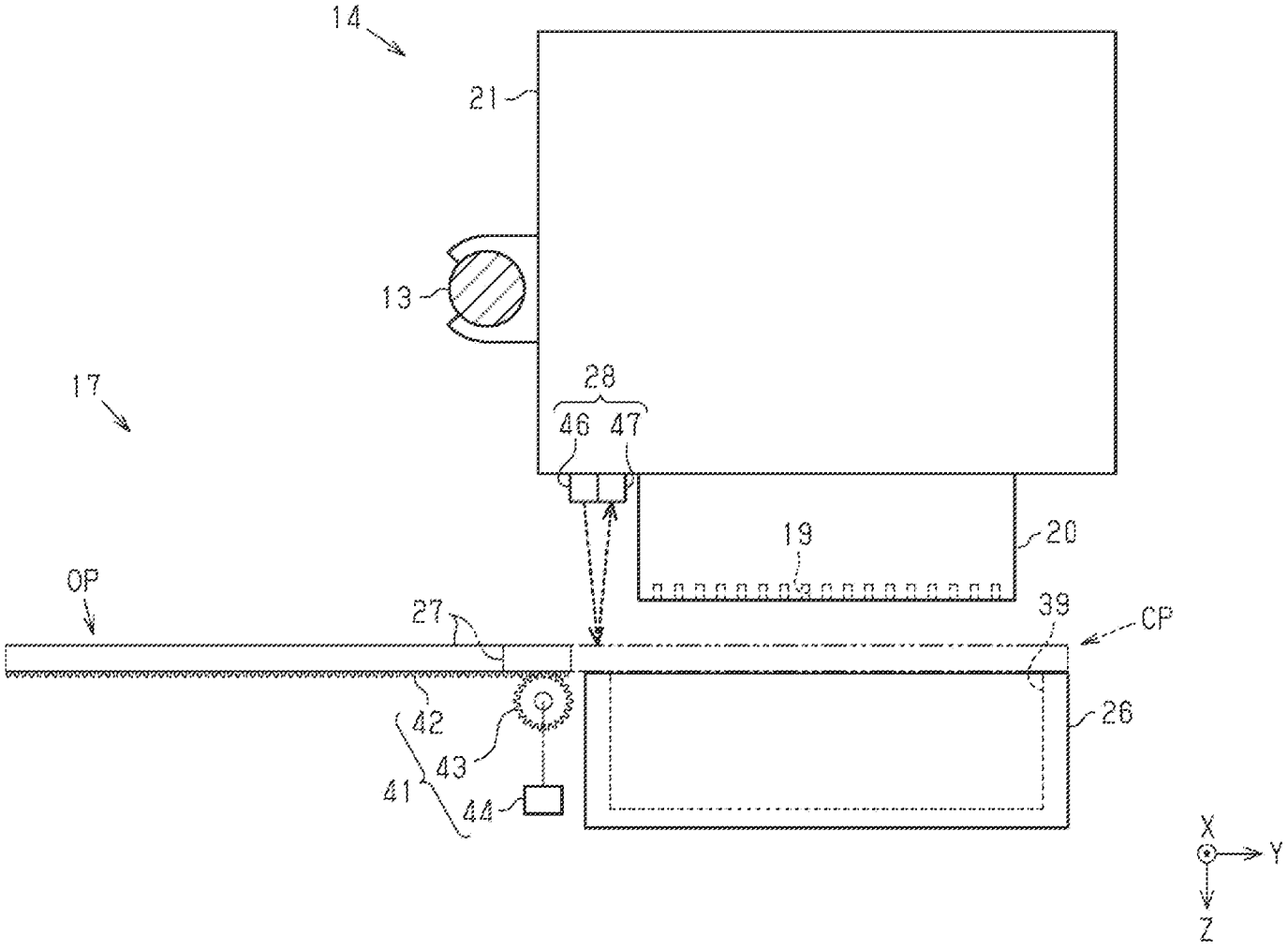
FIG. 2 is a schematic view illustrating a liquid accommodating unit and a cover.

As illustrated in FIG. 2, the liquid accommodating unit 26 receives liquid discharged from the liquid ejecting head 20 via an opening 39. The cover 27 is provided so as to be movable to a closed position CP illustrated by a two-dot chain line in FIG. 2 where the opening 39 of the liquid accommodating unit 26 is covered, and to an open position OP illustrated by a solid line in FIG. 2 where the opening 39 is opened. A portion of the cover 27 positioned at the closed position CP is positioned between the nozzle 19 and the liquid accommodating unit 26. An entirety of the cover 27 positioned at the open position OP is retracted from directly below the nozzle 19, and causes all of the nozzles 19 and the liquid accommodating unit 26 to face each other.

The maintenance portion 17 may include a movement mechanism 41 that moves the cover 27. The movement mechanism 41 includes a rack 42 provided at the cover 27, a pinion 43 that meshes with the rack 42, and a drive source 44 that rotates the pinion 43. The movement mechanism 41 moves the cover 27 from the closed position CP to the open position OP, by the drive source 44 driving forward. The movement mechanism 41 moves the cover 27 from the open position OP to the closed position CP, by the drive source 44 driving backward.

The detection unit 28 according to the present exemplary embodiment includes a light-emitting unit 46 that emits light, and a light-receiving unit 47 that receives light. The detection unit 28 may detect the cover 27 positioned at the closed position CP, by the light-receiving unit 47 receiving light reflected by the cover 27. The detection unit 28 may detect the cover 27 based on reflectance.

Next, a method for controlling the liquid ejecting apparatus 11 will be described with reference to a flowchart illustrated in FIG. 3. The control unit 37 performs a cover checking routine illustrated in FIG. 3, when movement of the cover 27 is instructed in another routine (not illustrated) performed by the control unit 37. The movement of the cover 27 from the closed position CP to the open position OP is, for example, instructed at least at any timing of, when the liquid ejecting apparatus 11 is powered on, before printing is started, during printing, and before empty discharging is performed. The movement of the cover 27 from the open position OP to the closed position CP is, for example, instructed at least at any timing of, when the liquid ejecting apparatus 11 is powered down, during printing, after printing is ended, and after empty discharging is performed.

Figure 3:
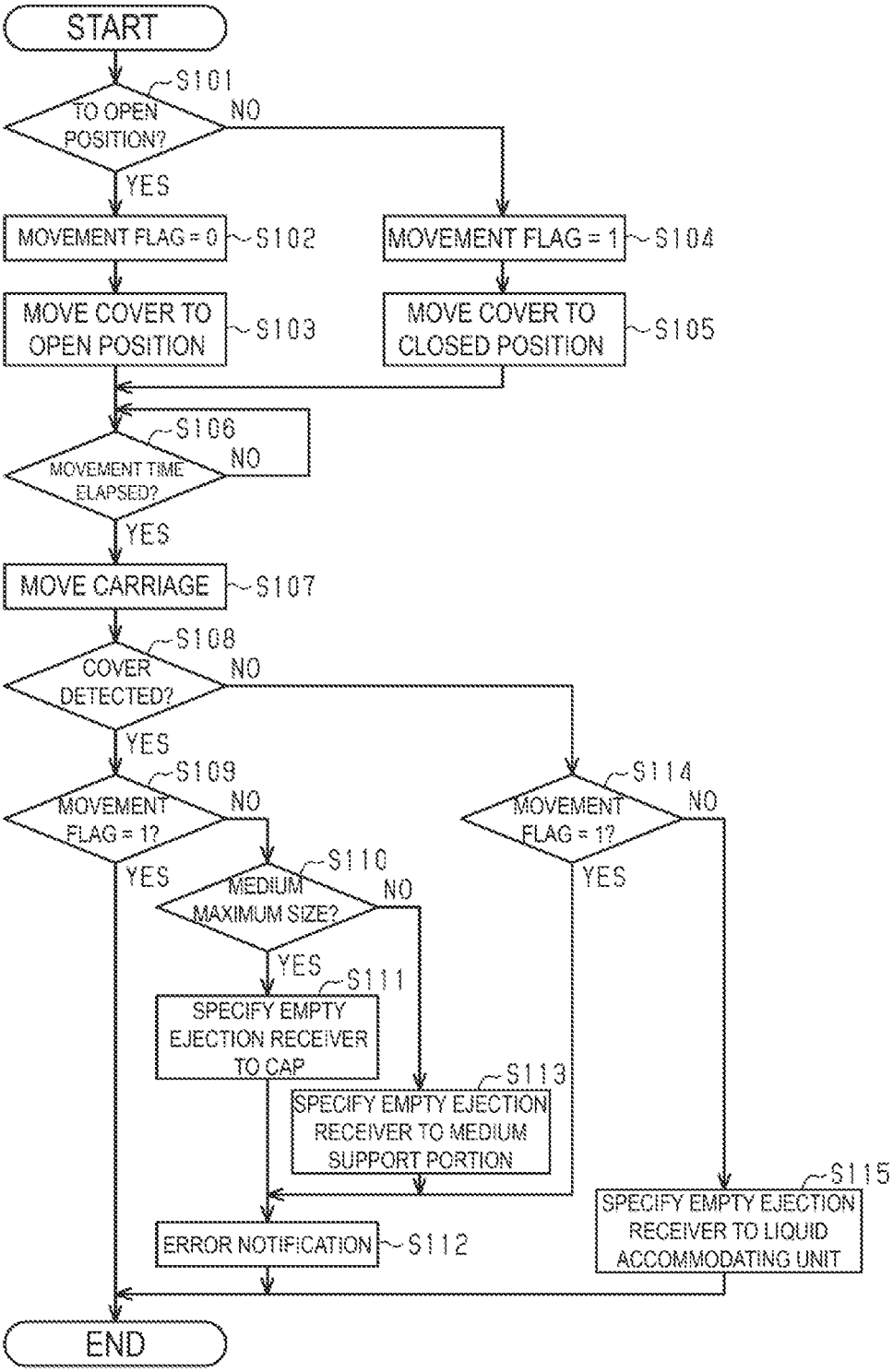
FIG. 3 is a flowchart illustrating a cover checking routine.

As illustrated in FIG. 3, in step S101, the control unit 37 determines whether the instructed movement of the cover 27 is from the closed position CP to the open position OP, or from the open position OP to the closed position CP.

In the case of the movement from the closed position CP to the open position OP, step S101 results in YES, and the control unit 37 transitions the processing to step S102. In step S102, the control unit 37 sets a movement flag to 0. In step S103, the control unit 37 drives the movement mechanism 41 to move the cover 27 to the open position OP, and transitions the processing to step S106.

In step S101, in the case of the movement from the open position OP to the closed position CP, step S101 results in NO, and the control unit 37 transitions the processing to step S104. In step S104, the control unit 37 sets the movement flag to 1. In step S105, the control unit 37 drives the movement mechanism 41 to move the cover 27 to the closed position CP, and transitions the processing to step S106.

In step S106, the control unit 37 determines whether a movement time elapses or not. The movement time is a time required for the cover 27 to move from the closed position CP to the open position OP, or from the open position OP to the closed position CP. When the movement time does not elapse since the movement of the cover 27 is started, the step S106 results in NO, and the control unit 37 waits until the movement time elapses. When the movement time elapses, step S106 results in YES, and the control unit 37 transitions the processing to step S107.

In step S107, the control unit 37 moves the carriage 21 above the liquid accommodating unit 26, and causes the detection unit 28 to detect presence or absence of the cover 27. In other words, the control unit 37 moves the carriage 21 to cause the cover 27 or the liquid accommodating unit 26 to face the detection unit 28. The detection unit 28 moves, in accordance with the movement of the carriage 21, to a position where the cover 27 positioned at the closed position CP can be detected. At this time, the control unit 37 may stop the carriage 21 such that the detection unit 28 is positioned above the liquid accommodating unit 26, or may move the carriage 21 such that the detection unit 28 passes above the liquid accommodation unit 26.

In step S108, the control unit 37 determines whether the detection unit 28 detects the cover 27 in step S107 or not. When the detection unit 28 detects the cover 27, step S108 results in YES, and the control unit 37 transitions the processing to step S109. In step S109, the control unit 37 determines whether the movement flag is 1 or not.

When the movement flag is 1, the step S109 results in YES, and the control unit 37 terminates the cover checking routine. In other words, when the movement of the cover 27 to the closed position is instructed, and the detection unit 28 detects that the cover 27 is positioned at the closed position CP, the control unit 37 terminates the cover checking routine.

Step S109 results in NO, when the movement flag is 0. The control unit 37 transitions the processing to step S110. In step S110, the control unit 37 determines whether a size of the medium 15 on which printing is performed is the maximum size available in the liquid ejecting apparatus 11 or not. When the cover checking routine is performed during power up, or the like, the size of the medium 15 is unknown in some cases. When the size of the medium 15 is unknown, the same process as in the case where the size of the medium 15 is the maximum size is performed.

When the size of the medium 15 is the maximum size, the step S110 results in YES, and the control unit 37 transitions the processing to step S111. In step S111, the control unit 37 specifies that the cap 31 receives liquid discharged from the liquid ejecting head 20 by empty discharging. In other words, when the control unit 37 determines that, despite that the movement of the cover 27 to the open position is instructed, the detection unit 28 detects the cover 27 positioned at the closed position CP and the opening 39 is not opened, and determines that there is no recessed portion 24 that is empty, discharging of liquid by empty discharging to the cap 31 is performed.

In step S112, the control unit 37 causes the notification unit 36 to notify of an error, and terminates the cover checking routine. When determining that, despite that the cover 27 is moved to the open position OP, the detection unit 28 detects the cover 27 positioned at the closed position CP, and the opening 39 is not opened, the control unit 37 performs notification.

In step S110, when the size of the medium 15 is not the maximum size, step S110 results in NO. The control unit 37 transitions the processing to step S113. In step S113, the control unit 37 specifies that the medium support portion 16 receives liquid discharged from the liquid ejecting head 20 by empty discharging. In other words, when the control unit 37 determines that, despite that the movement of the cover 27 to the open position OP is instructed, the detection unit 28 detects that the cover 27 positioned at the closed position CP, and the opening 39 is not opened, and determines that there is the recessed portion 24 that is empty, discharging of liquid by empty discharging to the medium support portion 16 is performed. More specifically, in the medium support portion 16, the recessed portion 24 positioned at a position away from the medium 15 may receive liquid discharged from the liquid ejecting head 20 by empty discharging.

In step S108, when the detection unit 28 does not detect the cover 27, step S108 results in NO, and the control unit 37 transitions the processing to step S114. In step S114, the control unit 37 determines whether the movement flag is 1 or not.

When the movement flag is 1, the step S114 results in YES, and the control unit 37 transitions the processing to S112. In step S112, the control unit 37 causes the notification unit 36 to notify of an error, and terminates the cover checking routine. When the control unit 37 determines that, despite that the cover 27 is moved to the closed position CP, the detection unit 28 does not detect the cover 27 positioned at the closed position CP, and the opening 39 is open, notification is performed.

Step S114 results in NO, when the movement flag is 0. The control unit 37 transitions the processing to step S115. In step S115, the control unit 37 specifies that the liquid accommodating unit 26 receives liquid discharged from the liquid ejecting head 20 by empty discharging. In other words, when the movement of the cover 27 to the open position OP is instructed, and the detection unit 28 does not detect the cover 27 positioned at the closed position CP, the control unit 37 determines that the cover 27 moves to the closed position OP and the opening 39 is opened. When control unit 37 determines that the opening 39 of the liquid accommodating unit 26 is opened from the detection result by the detection unit 28, discharging of liquid by empty discharging to the liquid accommodating unit 26 is performed.

Next, actions of the present embodiment will be described.

The control unit 37 detects that, after the movement of the cover 27 to the closed position CP is instructed, the cover 27 is moved to the closed position CP, by the detection unit 28. When, despite that the cover 27 is moved to the closed position CP, the detection unit 28 does not detect the cover 27 positioned at the closed position CP, the control unit 37 notifies that the cover 27 is not correctly operating, and the opening 39 is not closed.

The control unit 37 detects that, after the movement of the cover 27 to the open position OP is instructed, the cover 27 is moved to the open position OP by the detection unit 28. When, despite that the cover 27 is moved to the open position OP, the detection unit 28 detects the cover 27 positioned at the closed position CP, the control unit 37 notifies that the cover 27 is not correctly operating, and the opening 39 is not opened.

The control unit 37 may perform empty discharging, before printing, during printing, after suction cleaning, after wiping, and the like. When control unit 37 determines that the opening 39 of the liquid accommodating unit 26 is opened from the detection result by the detection unit 28, discharging of liquid by empty discharging to the liquid accommodating unit 26 is performed. When the control unit 37 determines that the opening 39 is not opened, discharging of liquid by empty discharging to the cap 31 or the medium support portion 16 is performed.

Effects of the present exemplary embodiment will now be described.

(1) The empty discharging is maintenance that can discharge liquid from the nozzle 19, thereby discharging foreign matter in the nozzle 19, or adjusting a meniscus. The liquid accommodating unit 26 receives liquid discharged by the empty discharging. The cover 27 can be positioned at the closed position CP and cover the opening 39 of the liquid accommodating unit 26, to suppress drying of liquid in the liquid accommodating unit 26. The detection unit 28 detects the cover 27 positioned at the closed position CP or the open position OP. Therefore, by performing the empty discharging, in a state where the detection unit 28 detects the cover 27 positioned at the open position OP, or does not detect the cover 27 positioned at the closed position CP, and the opening 39 of the liquid accommodating unit 26 is opened, a possibility that the cover 27 is contaminated can be reduced.

(2) The liquid ejecting head 20 and the detection unit 28 are movably mounted on the carriage 21. Thus, by moving the carriage 21, the liquid ejecting head 20 can be moved to a position where liquid can be discharged to the liquid accommodating unit 26, and the detection unit 28 can be moved to a position where the cover 27 can be detected.

(3) The liquid ejecting apparatus 11 includes the cap 31. The cap 31 can prevent liquid from evaporating out of the nozzle 19, by forming a closed space in which the nozzle 19 is open. When the control unit 37 determines that the opening 39 of the liquid accommodating unit 26 is not opened, discharging of liquid by empty discharging to the cap 31 is performed. In other words, even when liquid cannot be discharged to the liquid accommodating unit 26, the liquid ejecting head 20 can perform the empty discharging. Accordingly, a state of the nozzle 19 can be maintained in an appropriate state.

(4) When the control unit 37 determines that the opening 39 of the liquid accommodating unit 26 is not opened, discharging of liquid by empty discharging to the medium support portion 16 is performed. In other words, even when liquid cannot be discharged to the liquid accommodating unit 26, the liquid ejecting head 20 can perform the empty discharging. Accordingly, a state of the nozzle 19 can be maintained in an appropriate state.

(5) The liquid ejecting apparatus 11 includes the notification unit 36 for performing notification when the opening 39 of the liquid accommodating unit 26 is determined not to be opened. As a result, a user can grasp a state of the liquid accommodating unit 26.

The present exemplary embodiment described above may be modified as follows. The present exemplary embodiment and modified examples thereof to be described below may be implemented in combination within a range in which a technical contradiction does not arise.

The cover 27 may be moved by a user. The cover 27 may be detachably provided. In this case, the open position OP of the cover 27 may be a position where the cover 27 is removed from the liquid ejecting apparatus 11.

The detection unit 28 may detect the cover 27 positioned at the open position OP. When the detection unit 28 detects the cover 27, the control unit 37 may determine that the cover 27 is positioned at the open position OP.

The detection unit 28 may be configured by an optical sensor that converts light into an electrical signal. The detection unit 28 may detect the cover 27 by detecting a color of the cover 27. The detection unit 28 may detect the cover 27 by detecting a pattern formed at a surface of the cover 27. The detection unit 28 may be configured by an imaging sensor. The detection unit 28 may detect the cover 27 by analyzing an image obtained by capturing an inside of the liquid ejecting apparatus 11.

The detection unit 28 may detect the cover 27 positioned at the closed position CP or the open position OP, by being configured by a distance sensor that measures a distance, and measuring a distance to a target object. The distance sensor may measure a distance using infrared light, ultrasonic waves, magnetism, and the like, or may detect the position of the cover 27 relative to the distance sensor.

In addition to detecting the cover 27, the detection unit 28 may detect a position of liquid discharged from the liquid ejecting head 20 and adhering to the medium 15. For example, the detection unit 28 may detect liquid adhering to the medium 15 by a photoelectric sensor, or may detect a position to which liquid adheres by image analysis. Based on the detection result from the detection unit 28, the control unit 37 may perform a discharge correction for controlling the liquid ejecting head 20 so that, when there is a shift between a position to which liquid adheres and a desired position, the liquid adheres to the desired position.

In addition to detecting the cover 27, the detection unit 28 may detect an end of the medium 15. The detection unit 28 may detect the end of the medium 15 by means of a photoelectric sensor or image analysis. The control unit 37 may reflect a detection result from the detection unit 28 in the control of the liquid ejecting head 20. For example, the control unit 37 may perform borderless printing in accordance with a position of the end of the medium 15, or may adjust a position at which printing is performed. When the cover 27 does not move to the open position OP, and there is the recessed portion 24 positioned outside the end of the medium 15, the control unit 37 may cause empty discharging to be performed to this recessed portion 24. When the cover 27 does not move to the open position OP, and there is no recessed portion 24 outside the end of the medium 15, the control unit 37 may cause empty discharging to be performed to the cap 31.

In addition to detecting the cover 27, the detection unit 28 may detect a discharge failure of the liquid ejecting head 20 from an image printed on the medium 15. When a discharge failure occurs in some nozzles 19 of the plurality of nozzles 19 formed in the liquid ejecting head 20, a stripe occurs on an image printed. The detection unit 28 may detect a discharge failure by detecting the stripe by a photoelectric sensor or image analysis. When the detection unit 28 detects a liquid defect, the control unit 37 may perform cleaning of the liquid ejecting head 20. The cleaning may be suction cleaning, or pressurized cleaning that pressurizes liquid in the liquid ejecting head 20 and discharges the liquid from the nozzle 19.

The detection unit 28, in addition to detecting the cover 27, may detect a state of the medium 15. For example, the detection unit 28, when the medium 15 is a postal card, may detect a frame for filling a postal code. The control unit 37, based on a detection result from the detection unit 28, may determine a front or a back of the medium 15, or may determine an orientation of the medium 15. The control unit 37, when the medium 15 is in a state different from a desired state, may control the notification unit 36 to notify a user. The control unit 37, based on a detection result from the detection unit 28, may control the liquid ejecting head 20, to print a zip code in accordance with a position of a frame.

The detection unit 28, in addition to detecting the cover 27, may detect a height of the liquid ejecting head 20 with respect to the medium 15 or the medium support portion 16. The detection unit 28 may measure a distance to the medium 15 or the medium support portion 16 by, for example, a distance sensor. The liquid ejecting apparatus 11 may include an adjustment mechanism for adjusting the height of the liquid ejecting head 20. The height of the liquid ejecting head 20 with respect to the medium 15 varies depending on a thickness of the medium 15. The control unit 37, based on the detection result from the detection unit 28, may control the liquid ejecting head 20 so that discharged liquid adheres to a desired position.

The detection unit 28, in addition to detecting the cover 27, may detect an inclination of the medium 15. For example, the detection unit 28 may detect an inclination from an image on the medium 15. The control unit 37, based on a detection result from the detection unit 28, may control a transport unit that transports the medium 15, to correct the inclination.

The detection unit 28, in addition to detecting the cover 27, may detect a state of mist that scatters within the liquid ejecting apparatus 11. The detection unit 28 may analyze a captured image, for example, and detect a state of adhesion of liquid to a lens.

In addition to detection of the cover 27, the detection unit 28 may detect liquid leaked from a supply mechanism and the like for supplying liquid from a liquid accommodating unit accommodating liquid to the liquid ejecting head 20. The liquid ejecting apparatus 11 may include a guide passage for guiding leaked liquid onto the cover 27. The detection unit 28, by detecting liquid adhering to the cover 27, may detect leakage of liquid.

When the cover 27 is positioned at the closed position CP during printing, the control unit 37 may cease the printing. At this time, the control unit 37 may cause the notification unit 36 to notify that the cover 27 is at the closed position CP.

The control unit 37 may wait until empty discharging is performed in step S106 illustrated in FIG. 3. For example, when movement of the cover 27 is instructed, the control unit 37 may perform the processes in steps S101 to S105, and perform the processes in steps S107 to S115 before performing the empty discharging. In this case, the control unit 37 determines whether performance of empty discharging is instructed or not in step S106. In step S106, when the performance of the empty discharging is instructed, step S106 results in YES, and the control unit 37 transitions the processing to step S107. When the performance of the empty discharging is not instructed, step S106 results in NO, and the control unit 37 waits until performance of the empty discharging is instructed. When movement of the cover 27 is instructed during the waiting, the control unit 37 may transition the processing to step S101.

The control unit 37, after movement of the cover 27 to the closed position CP is instructed, need not detect movement of the cover 27 to the closed position CP by the detection unit 28. In other words, it is sufficient that, at least after the movement of the cover 27 to the open position OP is instructed, the control unit 37 detects movement of the cover 27 to the open position OP by the detection unit 28.

After movement of the cover 27 to the closed position CP is instructed, when determining that the cover 27 moves to the closed position CP and the opening 39 is not opened, the control unit 37 may notify that the cover 27 moves correctly. After the movement of the cover 27 to the open position OP is instructed, when determining that the cover 27 moves to the open position OP and the opening 39 is opened, the control unit 37 may notify that the cover 27 moves correctly.

The medium support portion 16 may receive liquid discharged by empty discharging at a portion different from the recessed portion 24. When the portion receiving the liquid at this time is provided outside a transport region for transporting the medium 15, a possibility that the medium 15 is contaminated by liquid adhering to the medium support portion 16 can be reduced.

When determining that the cover 27 does not move to the open position OP and the opening 39 is not opened, the control unit 37 may perform empty discharging to the cap 31 regardless of a size of the medium 15.

The wiping unit 30 may include a band-like member capable of absorbing liquid, and wipe the liquid ejecting head 20 using the band-like member. When determining that the cover 27 does not move to the open position OP and the opening 39 is not opened, the control unit 37 may perform empty discharging to the band-like member.

The detection unit 28 may be provided at a position different from that of the carriage 21. The detection unit 28 may detect the cover 27 positioned at the open position OP. In other words, the detection unit 28 may be provided within the housing 12 at a position where the cover 27 positioned at the closed position CP or the open position OP can be detected. As a result, the detection unit 28 can constantly detect the cover 27.

The detection unit 28 may be provided at a position in the carriage 21 where the cover 27 positioned at the open position OP can be detected. The detection unit 28 may detect the cover 27 positioned at the open position OP.

The liquid ejecting apparatus 11 may be a liquid ejecting apparatus that jets or discharges other liquids other than ink. States of liquid discharged from the liquid ejecting apparatus as a small amount of droplets include granules, tears, and string-like tails. As the liquid referred to here, a material that can be discharged from the liquid ejecting apparatus suffices. For example, it is sufficient that the liquid is in a state where a substance is in a liquid phase, and the liquid includes a fluid body such as a liquid body with high or low viscosity, sol, gel water, other inorganic solvents, organic solvents, solutions, liquid resins, liquid metals, metal melts. The liquid includes not only liquids as one state of a substance, but also particles of functional material consisting of solid substances such as pigments or metal particles are dissolved, dispersed, or mixed in a solvent. Representative examples of the liquid include inks, liquid crystals, and the like described in the above embodiments. Here, the inks include various liquid compositions such as a general aqueous ink and a solvent ink, a gel ink, and a hot-melt ink. For example, specific examples of the liquid ejecting apparatus include a device that discharges liquid including materials such as an electrode material and a color material used in manufacture of liquid crystal displays, electroluminescent (EL) displays, surface emitting displays, color filters and the like in a dispersed or dissolved form. As the liquid ejecting apparatus, a device discharging bioorganic substances used for biochip manufacturing, a device used as a precision pipette and discharging liquid to be a sample, a printing apparatus, a micro dispenser, or the like may be used. The liquid ejecting apparatus may be a device discharging lubricant to a precision machine such as a clock or a camera in a pinpoint manner, a device discharging transparent resin liquid such as ultraviolet cure resin or the like on a substrate for forming a tiny hemispherical lens, optical lens, or the like used for an optical communication element and the like. The liquid ejecting apparatus may be a device that discharges an etching solution such as acid or alkali to etch a substrate or the like.

Hereinafter, technical concepts and effects thereof that are understood from the above-described exemplary embodiments and modified examples will be described.

(A) A liquid ejecting apparatus includes a liquid ejecting head configured to eject liquid from a nozzle onto a medium to perform printing, a liquid accommodating unit configured to receive the liquid ejected by empty discharging that, separately from the printing, ejects liquid from the liquid ejecting head, via an opening, a cover movable to a closed position where the opening of the liquid accommodating unit is covered and an open position where the opening is opened, and a detection unit configured to detect the cover positioned at the closed position or the open position.

The empty discharging is maintenance capable of discharging foreign matter in the nozzle or adjusting a meniscus by ejecting liquid from the nozzle. According to this configuration, the liquid accommodating unit receives liquid ejected by the empty discharging. The cover can be positioned at the closed position and cover the opening of the liquid accommodating unit, to suppress drying of liquid in the liquid accommodating unit. The detection unit detects the cover positioned at the closed position or the open position. Therefore, by performing the empty discharging, in a state where the detection unit detects the cover positioned at the open position, or does not detect the cover positioned at the closed position, and the opening of the liquid accommodating unit is opened, a possibility that the cover is contaminated can be reduced.

(B) The liquid ejecting apparatus may further include a carriage movable in a state of being mounted with the liquid ejecting head, wherein the detection unit may be provided at the carriage, and move in accordance with movement of the carriage to a position where the cover positioned at the closed position or the open position can be detected.

According to this configuration, the liquid ejecting head and the detection unit are movably mounted on the carriage. Thus, by moving the carriage, the liquid ejecting head can be moved to a position where liquid can be discharged to the liquid accommodating unit, and the detection unit can be moved to a position where the cover can be detected.

(C) The liquid ejecting apparatus may further include a housing configured to accommodate the liquid ejecting head and the liquid accommodating unit, wherein the detection unit may be provided in the housing at a position where the cover positioned at the closed position or the open position can be detected. According to this configuration, the detection unit is provided at a position where the cover positioned at the closed position or the open position can be detected. Therefore, the cover can be constantly detected.

(D) The liquid ejecting apparatus further includes a cap capable of contacting the liquid ejecting head, and forming a closed space in which the nozzle is open, and a control unit configured to control operation of the liquid ejecting head, wherein the control unit, when determining that the opening of the liquid accommodating unit is opened from a detection result by the detection unit, may eject the liquid by the empty discharging to the liquid accommodating unit, and when determining that the opening is not opened, may eject the liquid by the empty discharging to the cap.

According to this configuration, the liquid ejecting apparatus includes the cap. The cap can prevent evaporation of liquid from the nozzle by forming the closed space in which the nozzle is open. When the control unit determines that the opening of the liquid accommodating unit is not opened, ejecting of the liquid by empty discharging to the cap is performed. In other words, even when the liquid cannot be ejected to the liquid accommodating unit, the liquid ejecting head can perform the empty discharging. Accordingly, a state of the nozzle can be maintained in an appropriate state.

(E) The liquid ejecting apparatus further includes a medium support portion configured to support the medium, and a control unit configured to control operation of the liquid ejecting head, wherein the control unit, when determining that the opening of the liquid accommodating unit is opened from a detection result by the detection unit, may discharge the liquid by the empty discharging to the liquid accommodating unit, and when the determining that the opening is not opened, may discharge the liquid by the empty discharging to the medium support portion.

According to this configuration, when the control unit determines that the opening of the liquid accommodating unit is not opened, ejecting of the liquid by the empty discharging to the medium support portion is performed. In other words, even when the liquid cannot be ejected to the liquid accommodating unit, the liquid ejecting head can perform the empty discharging. Accordingly, a state of the nozzle can be maintained in an appropriate state.

(F) The liquid ejecting apparatus may further include a notification unit configured to perform notification when the opening is determined not to be opened.

According to this configuration, the liquid ejecting apparatus includes the notification unit for performing notification when the opening of the liquid accommodating unit is determined not be opened. As such, a user can grasp a state of the liquid accommodating unit.

(G) A method for controlling a liquid ejecting apparatus is a control method for a liquid ejecting apparatus that includes a liquid ejecting head configured to eject liquid from a nozzle onto a medium to perform printing, a liquid accommodating unit configured to receive the liquid ejected by empty discharging that, separately from the printing, ejects liquid from the liquid ejecting head, via an opening, a cover movable to a closed position where the opening of the liquid accommodating unit is covered and an open position where the opening is opened, and a detection unit configured to detect the cover positioned at the closed position or the open position, wherein after movement of the cover to the open position is instructed, the detection unit detects that the cover moves to the open position. According to this configuration, the same effect as the liquid ejecting apparatus described above can be obtained.

(H) A method for controlling a liquid ejecting apparatus, after movement of the cover to the closed position is instructed, movement of the cover to the closed position may be detected by the detection unit.

According to this configuration, the same effect as the liquid ejecting apparatus described above can be obtained.

What is claimed is:

1. A liquid ejecting apparatus, comprising:

a liquid ejecting head configured to eject liquid from a nozzle onto a medium to perform printing;

a carriage configured to move in a state of being mounted with the liquid ejecting head;

a liquid accommodating unit configured to receive, via an opening, the liquid ejected by empty discharging which ejects the liquid from the liquid ejecting head separately from the printing;

a cover configured to move to a closed position where the opening of the liquid accommodating unit is covered and an open position where the opening is opened, the cover configured to move independently of the movement of the carriage; and a detection unit configured to detect the cover positioned at the closed position or the open position.

2. The liquid ejecting apparatus according to claim 1, further comprising:

a housing configured to accommodate the liquid ejecting head and the liquid accommodating unit, wherein the detection unit is provided, in the housing, at a position where the cover positioned at the closed position or the open position is detectable.

3. The liquid ejecting apparatus according to claim 1, further comprising:

a cap configured to contact the liquid ejecting head to form a closed space in which the nozzle is open; and a control unit configured to control operation of the liquid ejecting head, wherein the control unit, when determining that the opening of the liquid accommodating unit is opened from a detection result by the detection unit, ejects the liquid by the empty discharging to the liquid accommodating unit, and when determining that the opening is not opened, ejects the liquid by the empty discharging to the cap.

4. The liquid ejecting apparatus according to claim 1, further comprising:

a medium support portion configured to support the medium; and a control unit configured to control operation of the liquid ejecting head, wherein the control unit, when determining that the opening of the liquid accommodating unit is opened from a detection result by the detection unit, ejects the liquid by the empty discharging to the liquid accommodating unit, and when determining that the opening is not opened, ejects the liquid by the empty discharging to the medium support portion.

5. The liquid ejecting apparatus according to claim 1, further comprising:

a notification unit configured to perform notification when the opening is determined to be not open.

6. The liquid ejecting apparatus according to claim 1, wherein the detection unit is provided at the carriage, and the detection unit is configured to move in accordance with movement of the carriage to a position where the cover positioned at the closed position or the open position is detectable.

7. A liquid ejecting apparatus, comprising:

a liquid ejecting head configured to eject liquid from a nozzle onto a medium to perform printing;

a carriage configured to move in a state of being mounted with the liquid ejecting head;

a liquid accommodating unit configured to receive, via an opening, the liquid ejected by empty discharging which ejects the liquid from the liquid ejecting head separately from the printing;

a cover configured to move to a closed position where the opening of the liquid accommodating unit is covered and an open position where the opening is opened; and a detection unit configured to detect the cover positioned at the closed position or the open position, wherein the detection unit is provided at the carriage, and the detection unit is configured to move in accordance with movement of the carriage to a position where the cover positioned at the closed position or the open position is detectable.

8. The liquid ejecting apparatus according to claim 7, further comprising:

a housing configured to accommodate the liquid ejecting head and the liquid accommodating unit, wherein the detection unit is provided, in the housing, at a position where the cover positioned at the closed position or the open position is detectable.

9. The liquid ejecting apparatus according to claim 7, further comprising:

a cap configured to contact the liquid ejecting head to form a closed space in which the nozzle is open; and a control unit configured to control operation of the liquid ejecting head, wherein the control unit, when determining that the opening of the liquid accommodating unit is opened from a detection result by the detection unit, ejects the liquid by the empty discharging to the liquid accommodating unit, and when determining that the opening is not opened, ejects the liquid by the empty discharging to the cap.

10. The liquid ejecting apparatus according to claim 7, further comprising:

a medium support portion configured to support the medium; and a control unit configured to control operation of the liquid ejecting head, wherein the control unit, when determining that the opening of the liquid accommodating unit is opened from a detection result by the detection unit, ejects the liquid by the empty discharging to the liquid accommodating unit, and when determining that the opening is not opened, ejects the liquid by the empty discharging to the medium support portion.

11. The liquid ejecting apparatus according to claim 7, further comprising:

a notification unit configured to perform notification when the opening is determined to be not open.

* * * * *